United States Patent [19]

Kimoto et al.

[11] Patent Number: 4,469,572

[45] Date of Patent: Sep. 4, 1984

[54] METHOD OF CONTINUOUSLY PROCESSING A BAND-SHAPE MATERIAL

[75] Inventors: Yasuo Kimoto, Fujiidera; Masahiko Yamamoto, Nishinomiya; Katsunori Tamiya, Kobe; Yoshihito Sakai, Sakai; Akio Komura; Shoichi Honda, both of Osaka; Hidehiko Maehata, Suita; Hiroshi Kamada, Takatsuki; Tomohiko Suzaki, Ibaraki; Tomoya Inoue, Kawasaki, all of Japan

[73] Assignee: Hitachi Shipbuilding & Engineering Co., Ltd., Japan

[21] Appl. No.: 241,651

[22] Filed: Mar. 9, 1981

[30] Foreign Application Priority Data

Mar. 12, 1980 [JP] Japan ..... 55-31096

[51] Int. Cl.[3] ..... C25F 3/16

[52] U.S. Cl. ..... 204/129.46; 204/28; 204/29; 204/32.1; 427/327

[58] Field of Search ..... 204/28, 29, 32 R, 129.46, 204/224 M; 427/307, 309, 327

[56] References Cited

U.S. PATENT DOCUMENTS

| | | | |
|---|---|---|---|
| 3,556,957 | 1/1971 | Toledo et al. | 204/32 |
| 3,853,717 | 12/1974 | Diguilio | 204/28 |
| 4,140,598 | 2/1979 | Kimoto et al. | 204/129.4 |

OTHER PUBLICATIONS

Metal Finishing Guidebook and Directory for 1978, Metals and Plastics Publications, Inc., Hackensack, N.J., pp. 496-501.

*Primary Examiner*—G. L. Kaplan
*Assistant Examiner*—W. T. Leader
*Attorney, Agent, or Firm*—Darby & Darby

[57] ABSTRACT

The present invention discloses a method of continuously processing a ribbonlike material. The method is characterized by comprising a preliminary polishing step in which surface defects of a material pulled out from an uncoiler are removed and the surface of the material is semi-finished by abrasion in combination with electrolytic polishing, a final polishing step in which the surface of the material is mirror-finished by abrasion in combination with electrolytic polishing, a washing and drying step in which the material is washed and dried with extraneous matter on the surface of the material washingly removed, a surface inspection step in which the thus finished surface of the material is inspected as to surface roughness and defects, a surface protection step in which a protective film is applied to the finished surface of the material, and a press step in which the material is cut into a predetermined size.

According to the present invention, processes of mirror-finishing the surface of a ribbonlike material pulled out from an uncoiler and cutting such material into a predetermined size are continuously performed in an efficient and automatic manner.

1 Claim, 3 Drawing Figures

METHOD OF CONTINUOUSLY PROCESSING A BAND-SHAPE MATERIAL

FIELD OF THE INVENTION

The present invention relates to a method of continuously processing a ribbonlike material, according to which processes of mirror-finishing the surface and cutting such material into a predetermined size, are continuously performed.

BACKGROUND OF THE INVENTION

For mirror-finishing the inner surface of a larger-size tank, there is conventionally used an abrasion in combination with electrolytic polishing in which an electrolytic operation is combined with abrasion performed with an abrasive matter. According to this technique, a polishing tool is moved with the tank fixed. Therefore, such technique cannot be applied to mirror-finishing of a continuous ribbonlike material.

SUMMARY OF THE INVENTION

The present invention provides a method of continuously processing a ribbonlike material, comprising a preliminary polishing step in which surface defects of a material pulled out from an uncoiler are removed and the surface of the material is semi-finished by abrasion in combination with electrolytic polishing, a final polishing step in which the surface of the material is mirror-finished by abrasion in combination with electrolytic polishing, a washing and drying step in which the material is washed and dried wherein extraneous matter on the surface of the material is washingly removed, a surface inspection step in which thus finished surface of the material is inspected as to surface roughness and defect, a surface protection step in which a protective film is applied to the finished surface of the material, and a press step in which the material is cut into a predetermined size.

BRIEF DESCRIPTION OF THE DRAWINGS

The invention will further be described, by way of example, with reference to the accompanying drawings, in which.

DETAILED DESCRIPTION OF PREFERRED EMBODIMENTS

The description hereinafter will discuss an embodiment of the present invention with reference to the accompanying drawings.

Figure 1:
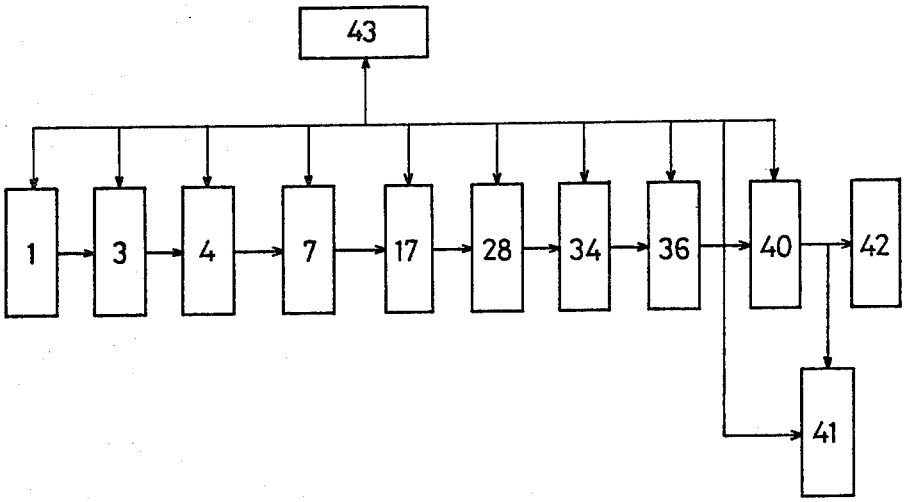
FIG. 1 is a block diagram showing the respective steps in a method of continuously processing a ribbonlike material in accordance with the present invention.
Figure 3:
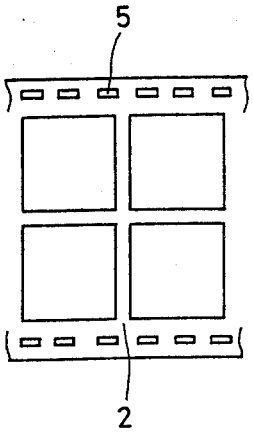
FIG. 3 is a plan view of a portion of material.
Figure 2:
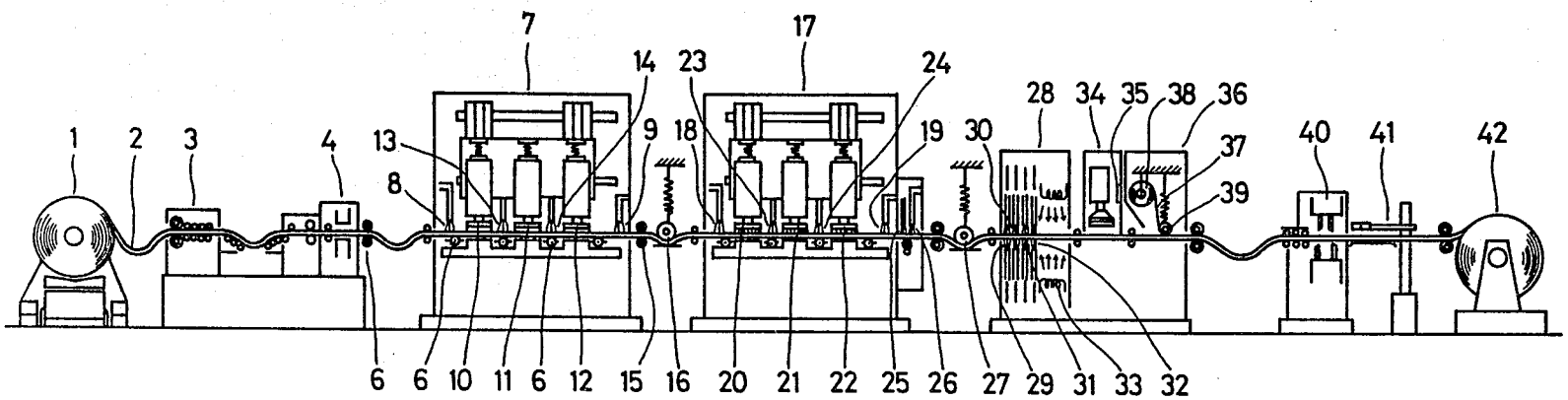
FIG. 2 is a schematic diagram of the steps of FIG. 1.

In FIGS. 1 to 3, a ribbonlike material 2 loaded to an uncoiler 1 is pulled out to a leveler 3 which adjusts the ribbonlike material 2 so as to be flat, and is then sent to a perforating and press step 4. In this press step 4, holes 5 are formed in the band-shape material 2 at both edges thereof such that the band-shape material 2 thereafter travels at a predetermined speed by sprockets 6.

In a preliminary polishing step 7, surface defects of the material 2 are removed and the surface of the material 2 is semi-finished by means of abrasion in combination with electrolytic polishing. Namely, air curtains 8 and 9 are disposed at the inlet and outlet of the preliminary polishing step 7, respectively. Disposed between these air curtains 8 and 9 are first, second and third tools of abrasion in combination with electrolytic polishing 10, 11 and 12. Shower curtains 13 and 14 are disposed between the tools 10 and 11, and between the tools 11 and 12, respectively.

These tools 10, 11 and 12 are so constructed that abrasive matter is radially formed on the surfaces of circular electrodes, and electrolytes are supplied to the gaps between the material 2 and the abrasive matter from through-bores formed in the electrodes at the centers thereof, so that electrolytic polishing and abrasion made by the abrasive matter is performed with the tools rotated.

The grain sizes of the abrasive matter of the tools 10, 11 and 12 become gradually finer in the downstream direction. The tools 10, 11 and 12 are pressed to the ribbonlike material 2 at a predetermined force by springs.

The shower curtains 13 and 14 partition the electrolytes in the tools 10, 11 and 12 from each other, and the air curtains 8 and 9 prevent the electrolytes from flowing to the outside.

The ribbonlike material 2 is sent to a final polishing process 17 through a dehydrating roller 15 and an absorption roller 16 for absorbing the looseness of the ribbonlike material 2. In this final polishing process 17, the ribbonlike material 2 is mirror-finished.

Like the previous step 7, this process 17 is provided with air curtains 18 and 19, first, second and third tools of abrasion in combination with electrolytic polishing 20, 21 and 22, and shower curtains 23 and 24.

The abrasive matter of the tools 20, 21 and 22 have grain sizes much finer than those of the abrasive matters in the previous step 7, and the grain sizes of the abrasive matter of the tools 20, 21 and 22 become gradually finer in the downstream direction.

After having passed through the final polishing step 17, the ribbonlike material 2 passes through a coarse-washing shower 25, an air curtain 26 and an absorption roller 27, and is sent to a washing and drying step 28.

In this washing and drying step 28, extraneous matter on the surface of the material 2 is washingly removed by showers 29, 30 and 31 disposed at the upper and lower sides of the material 2. Then, the material 2 is dried by air curtains 32 and heater means 33.

The ribbonlike material 2 is then sent to a surface inspection step 34, where the material 2 is checked as to surface roughness and defect, and if there are detected defective portions, such portions are marked by marker means 35.

The band-shape material 2 is then sent to a surface protection step 36, where a protective film 37 is applied to the surface of the material 2. Namely, a protective film 37 made of a synthetic resin to which bonding material is applied and which is wound on a reel 38, is pulled out by a pressing roller 39, thereby to be applied, in lamination, to the band-shape material 2.

Then, in a press step 4, the band-shape material 2 is cut into a predetermined size as shown in FIG. 3, so that punched-out products are taken out by handling means 41, with residual material 2 wound on a winder 42.

It is to be noted that such steps are all controlled by a control device 43.

Although in the embodiment discussed hereinbefore, the feed of material 2 is performed by the through-holes 5 and the sprockets 6, other suitable means such as pinch rolls or chain belts may also be used.

As thus discussed hereinbefore, a method of continuously processing a ribbonlike material according to the present invention, processes of mirror-finishing the surface of a band-shape material pulled out from an uncoiler and cutting such material into a predetermined size are continuously performed in an efficient and automatic manner.

What is claimed is:

1. A method for continuously processing a ribbon-like material comprising:

a preliminary polishing step in which surface defects of material pulled out from an uncoiler are removed and the surface of the material is semi-finished by exposing said ribbon-like material to first, second and third combined electrolytic and polishing steps, wherein each of said combined steps includes supplying abrasive matter to the surface of circular electrodes by means of a bore hole in the center of said electrodes, supplying electrolytes to a gap separating said ribbon-like material and said circular electrodes, and pressing said ribbon-like material to said circular electrodes with a predetermined force, wherein said first, second and third polishing steps utilize first, second and third abrasives which are progressively finer;

a final polishing step in which the surface of the material is mirror finished comprising exposing said ribbon-like material to fourth, fifth and sixth combined electrolytic and polishing steps, wherein each of said combined steps include supplying abrasive matter to the surface of a circular electrode by means of a bore hole in the center of said electrode, supplying electrolytes to a gap separating said ribbon-like material and said circular electrodes, and pressing said ribbon-like material to said electrodes with a predetermined force wherein said fourth, fifth and sixth steps utilize fourth, fifth and sixth abrasives finer than said first, second and third abrasives and which become progressively finer;

a washing and drying step in which said ribbon-like material is washed and dried to remove extraneous matter from the surface of said ribbon-like material, said washing step comprising a first step for washing coarse materials from said ribbon-like material and a second step including first, second and third showering steps for showering upper and lower sides of said ribbon-like material to clean residues therefrom, and said drying step includes an air drying step and a heat drying step;

a surface inspection step in which a finished surface of said ribbon-like material is inspected for surface roughness and defects;

a surface protection step in which a protective film is applied to the finished surface of said ribbon-like material; and a press step in which said ribbon-like material is cut into predetermined sizes.

* * * * *